US012507740B2

(12) United States Patent
Lee et al.

(10) Patent No.: US 12,507,740 B2
(45) Date of Patent: Dec. 30, 2025

(54) AEROSOL GENERATING APPARATUS INCLUDING PRESSURE SENSOR

(71) Applicant: KT&G CORPORATION, Daejeon (KR)

(72) Inventors: Jaemin Lee, Siheung-si (KR); Ji Hyun Jo, Suwon-si (KR); Heon Jun Jeong, Seoul (KR)

(73) Assignee: KT&G CORPORATION, Daejeon (KR)

( * ) Notice: Subject to any disclaimer, the term of this patent is extended or adjusted under 35 U.S.C. 154(b) by 482 days.

(21) Appl. No.: 17/617,778

(22) PCT Filed: Jul. 30, 2021

(86) PCT No.: PCT/KR2021/009958
§ 371 (c)(1),
(2) Date: Dec. 9, 2021

(87) PCT Pub. No.: WO2022/045605
PCT Pub. Date: Mar. 3, 2022

(65) Prior Publication Data

US 2023/0165313 A1 Jun. 1, 2023

(30) Foreign Application Priority Data

Aug. 31, 2020 (KR) ..... 10-2020-0110592

(51) Int. Cl.
*A24F 40/53* (2020.01)
*A24F 40/20* (2020.01)

(52) U.S. Cl.
CPC ..... *A24F 40/53* (2020.01); *A24F 40/20* (2020.01)

(58) Field of Classification Search
CPC ..... A24F 40/53; A24F 40/20
See application file for complete search history.

(56) References Cited

U.S. PATENT DOCUMENTS

2004/0030508 A1* 2/2004 Likness ..... A24F 47/00 702/45
2016/0374397 A1* 12/2016 Jordan ..... G01L 19/0092 131/329

(Continued)

FOREIGN PATENT DOCUMENTS

CN 107080291 A 8/2017
CN 207383530 U 5/2018

(Continued)

OTHER PUBLICATIONS

Office Action issued Apr. 22, 2023 in Chinese Application No. 202180004066.6.

(Continued)

*Primary Examiner* — Michael H. Wilson
*Assistant Examiner* — Jennifer A Kessie
(74) *Attorney, Agent, or Firm* — Sughrue Mion, PLLC

(57) ABSTRACT

According to an embodiment, an aerosol generating apparatus includes an accommodation portion configured to accommodate an aerosol generating article, a pressure sensor configured to detect pressure in the accommodation portion, and a controller configured to determine whether the aerosol generating article is inserted into or removed from the accommodation portion and whether a user's puff has occurred on the aerosol generating article, based on whether pressure detected by the pressure sensor is increased or reduced from a reference value.

11 Claims, 4 Drawing Sheets

(56) References Cited

U.S. PATENT DOCUMENTS

| | | | |
|---|---|---|---|
| 2018/0368474 | A1 | 12/2018 | Bache et al. |
| 2020/0037663 | A1 | 2/2020 | Chau et al. |
| 2020/0093185 | A1 | 3/2020 | Lim |
| 2020/0154773 | A1 | 5/2020 | Lim et al. |
| 2020/0352244 | A1 | 11/2020 | Lim et al. |
| 2021/0068456 | A1 | 3/2021 | Bessant et al. |
| 2021/0106051 | A1 | 4/2021 | Han et al. |
| 2021/0127748 | A1 | 5/2021 | Lim et al. |

FOREIGN PATENT DOCUMENTS

| | | | | |
|---|---|---|---|---|
| CN | 110916252 | A | 3/2020 | |
| CN | 210382652 | U | 4/2020 | |
| CN | 111109669 | A | 5/2020 | |
| EP | 3632240 | A1 | 4/2020 | |
| EP | 3711542 | A1 * | 9/2020 | ..... A24F 40/53 |
| JP | 2019-534045 | A | 11/2019 | |
| JP | 2020-18285 | A | 2/2020 | |
| JP | 6651667 | B1 | 2/2020 | |
| KR | 10-2018-0111460 | A | 10/2018 | |
| KR | 10-2018-0129637 | A | 12/2018 | |
| KR | 10-2019-0019114 | A | 2/2019 | |
| WO | 2016/009202 | A1 | 1/2016 | |
| WO | 2018/184861 | A1 | 10/2018 | |
| WO | 2018/216961 | A1 | 11/2018 | |
| WO | 2019/096983 | A1 | 5/2019 | |
| WO | 2020/009457 | A1 | 1/2020 | |
| WO | 2020/055696 | A1 | 3/2020 | |
| WO | WO-2020193196 | A1 * | 10/2020 | ..... A24F 40/53 |

OTHER PUBLICATIONS

Japanese Office Action dated Jan. 17, 2023 in Japanese Application No. 2021-574745.

Extended European Search Report dated Jun. 15, 2022 from the European Patent Office in EP Application No. 21814665.2.

International Search Report for PCT/KR2021/009958 dated Nov. 2, 2021.

Written Opinion for PCT/KR2021/009958 dated Nov. 2, 2021.

Office Action issued Jun. 6, 2023 in Japanese Application No. 2021-574745.

* cited by examiner

[Fig. 1]
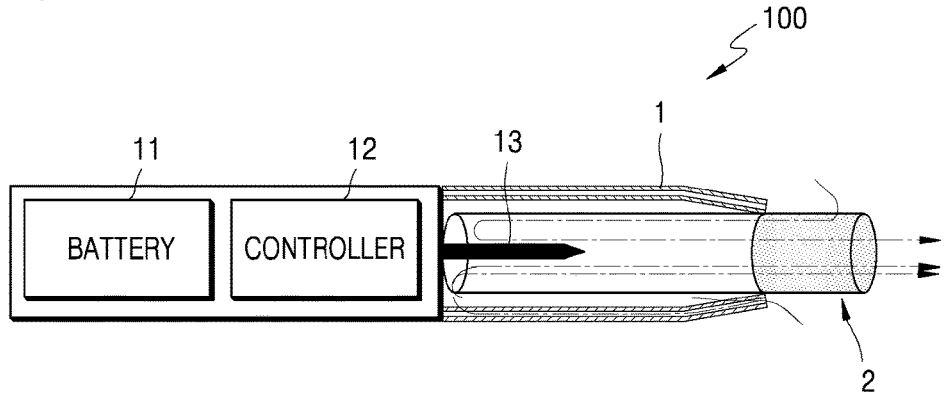
[Fig. 2]
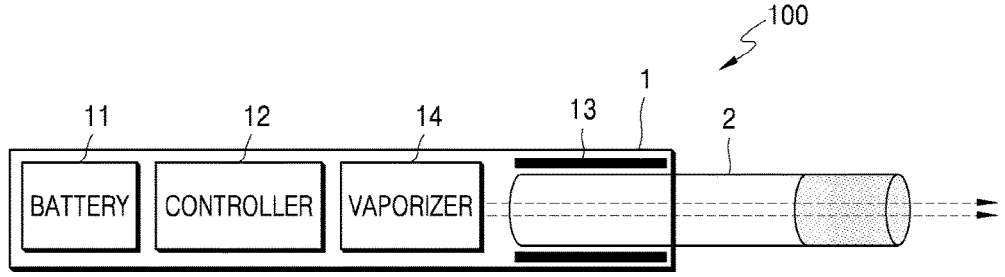
[Fig. 3]
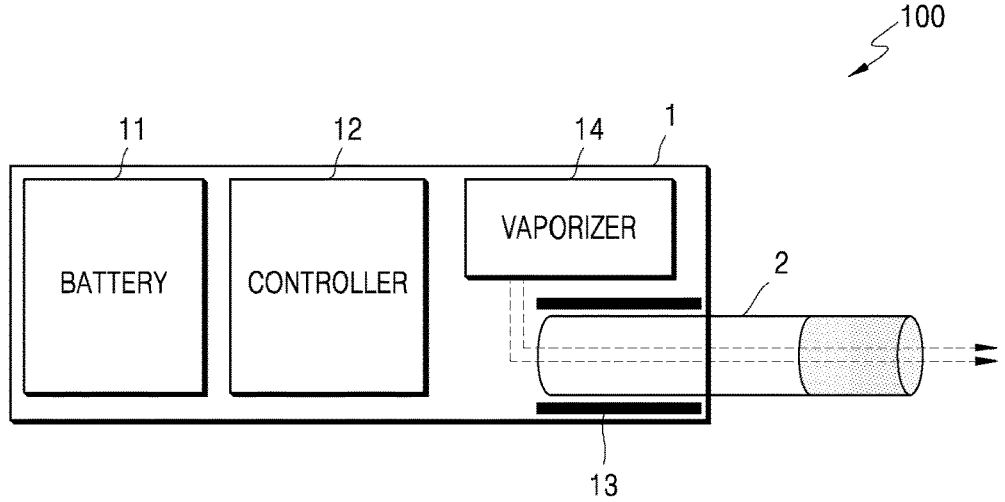
[Fig. 4]
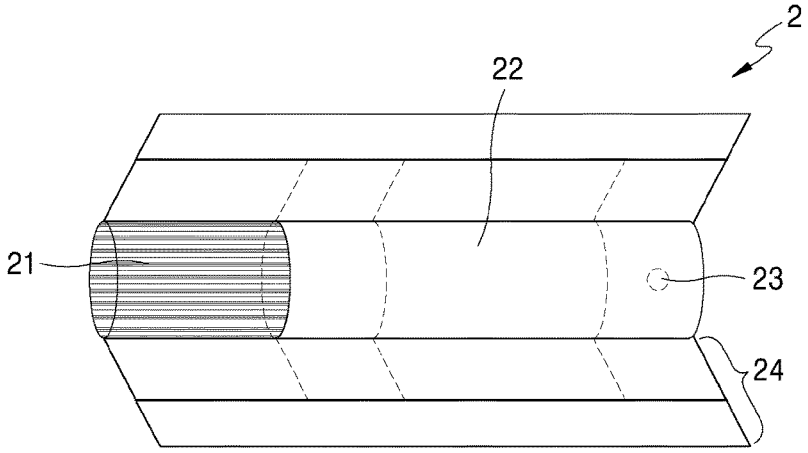

[Fig. 5]
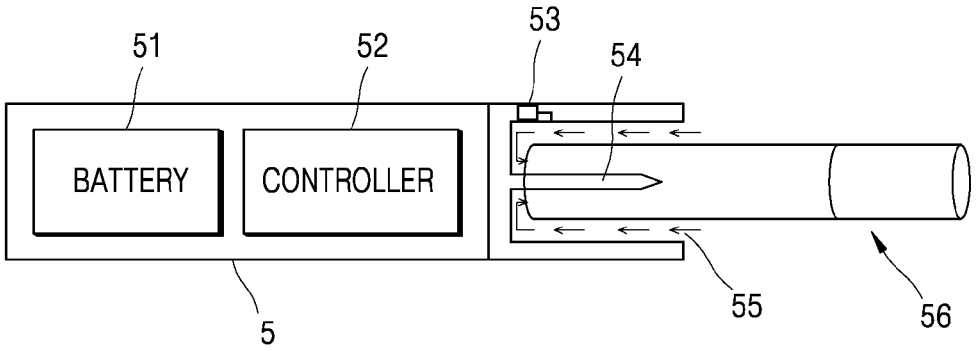
[Fig. 6]
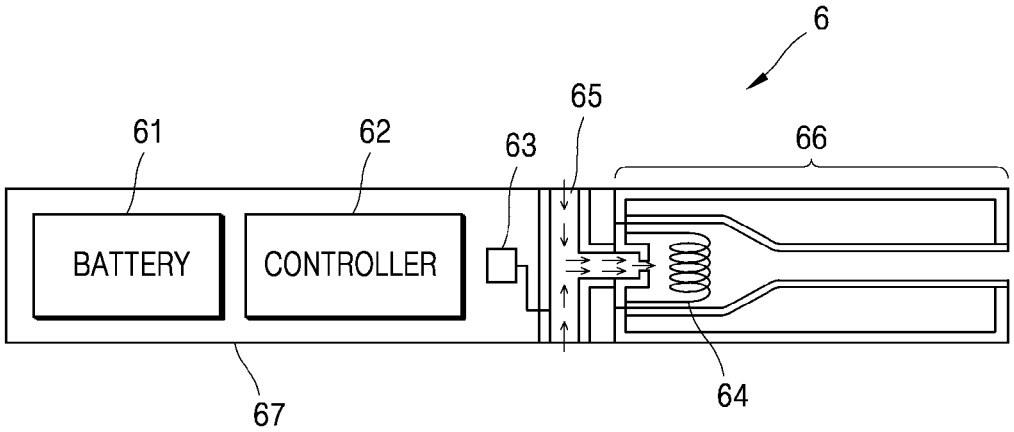
[Fig. 7]
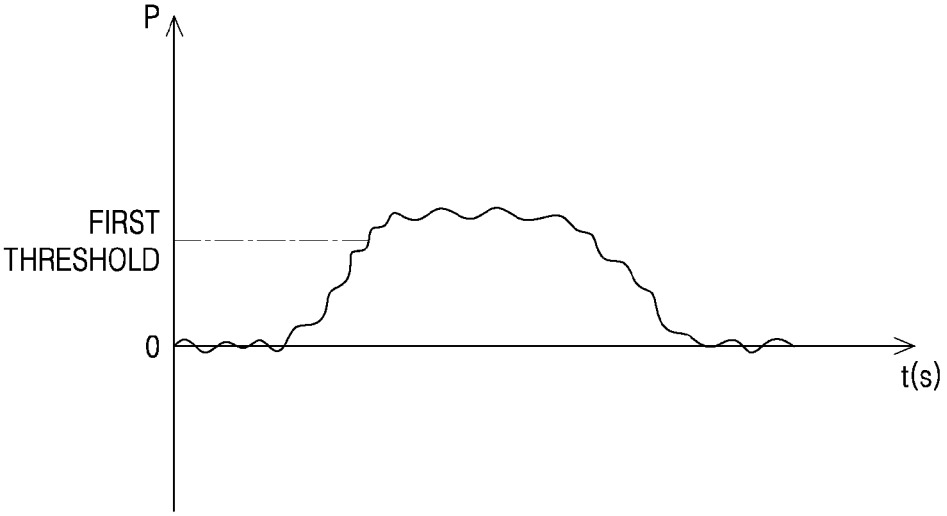

[Fig. 8]
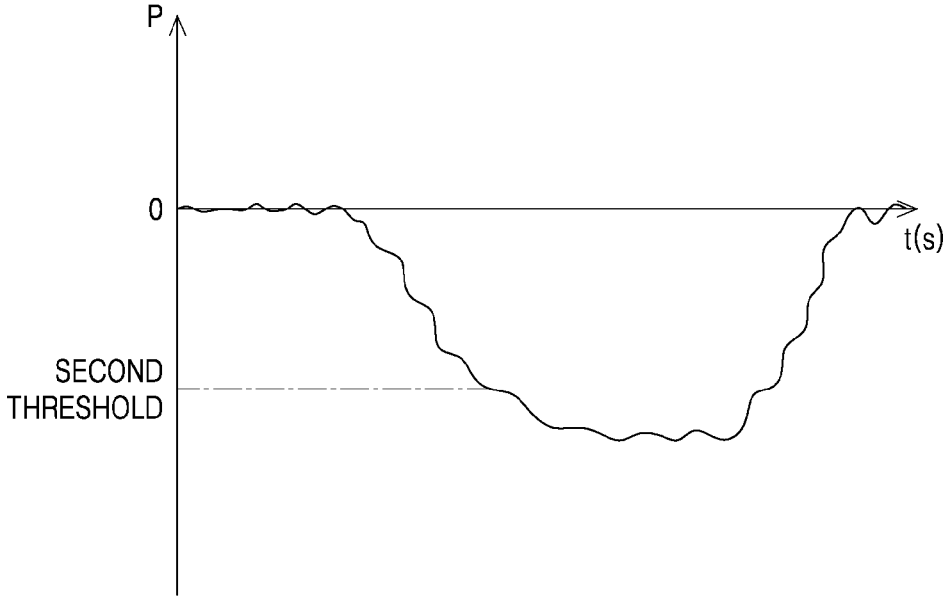
[Fig. 9]
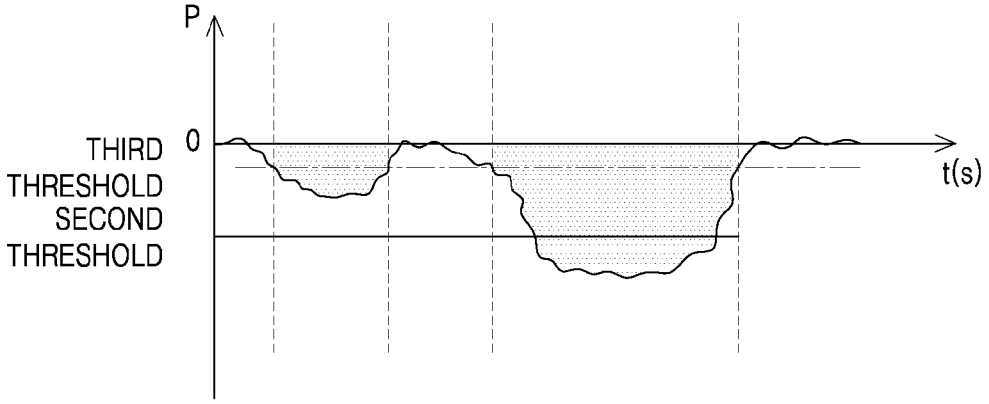
[Fig. 10A]
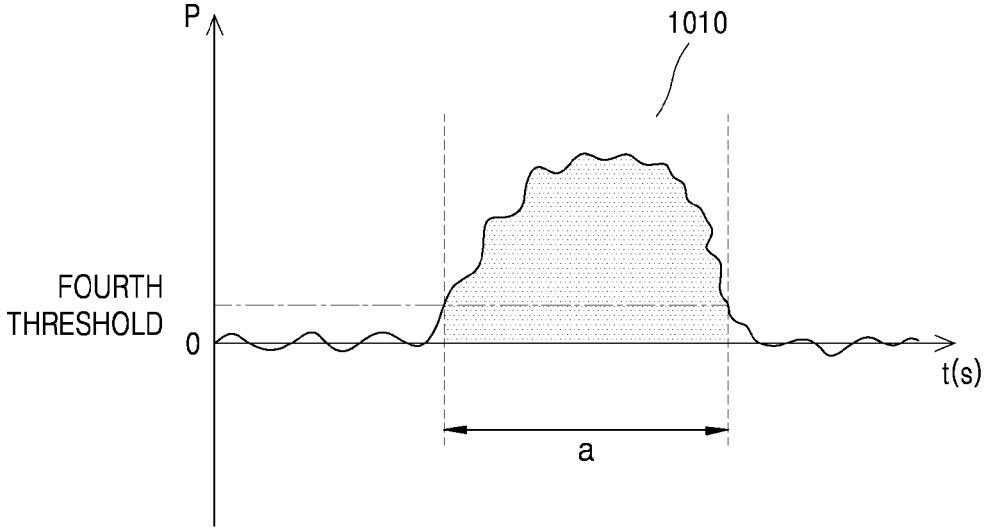

[Fig. 10B]
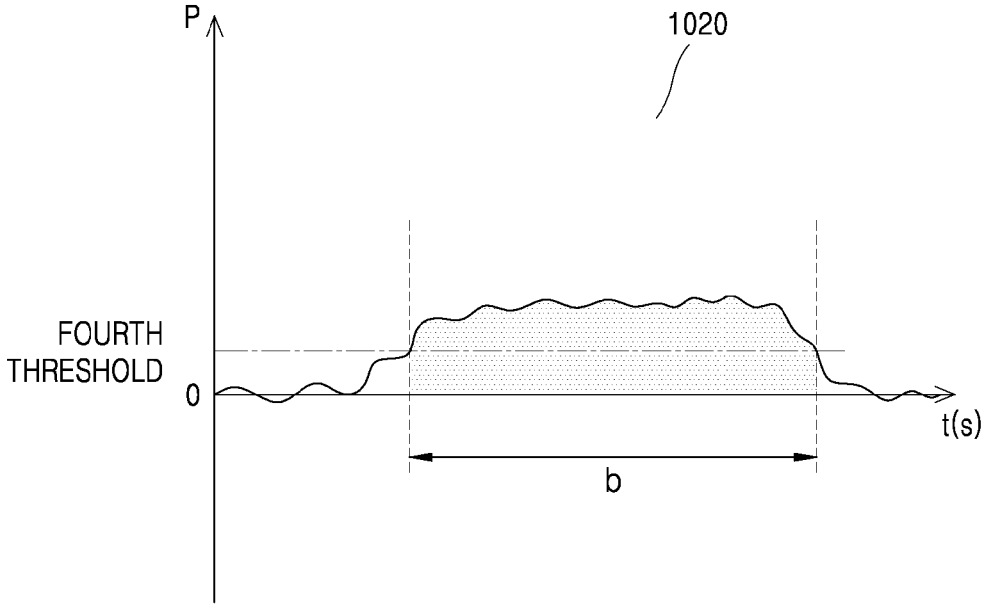
[Fig. 11]
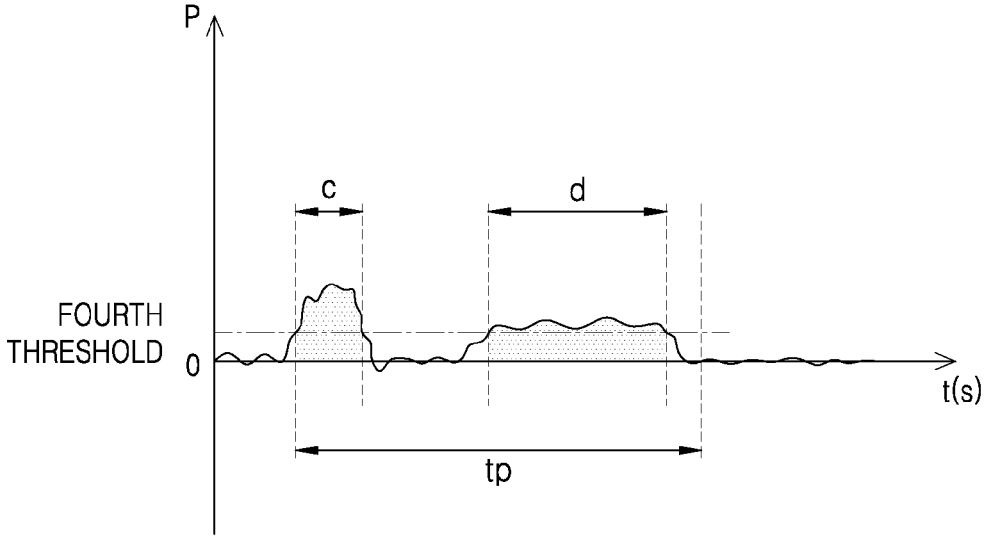
[Fig. 12]
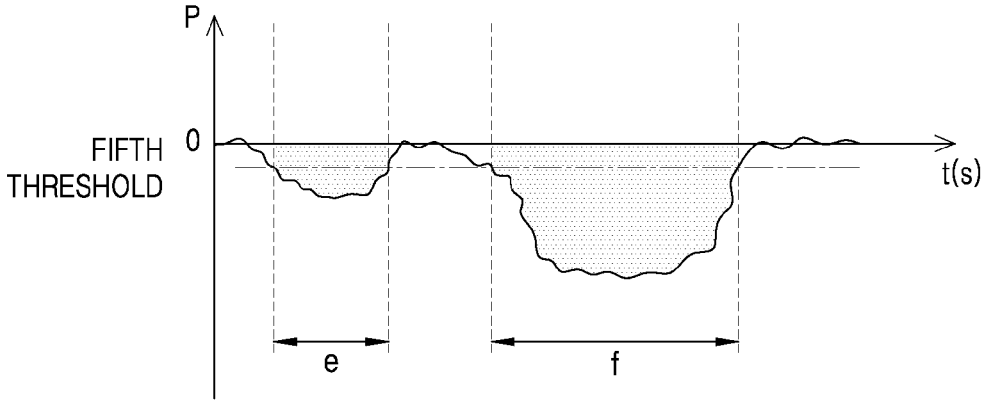

AEROSOL GENERATING APPARATUS INCLUDING PRESSURE SENSOR

CROSS REFERENCE TO RELATED APPLICATIONS

This application is a National Stage of International Application No. PCT/KR2021/009958 filed Jul. 30, 2021, claiming priority based on Korean Patent Application No. 10-2020-0110592 filed Aug. 31, 2020.

TECHNICAL FIELD

Embodiments of the present disclosure relate to an aerosol generating apparatus including a pressure sensor.

BACKGROUND ART

Recently, the demand for alternative methods to overcome the disadvantages of traditional aerosol generating articles has increased. For example, there is growing demand for an aerosol generating device which generates aerosol by heating an aerosol generating material in aerosol generating articles, rather than by combusting aerosol generating articles. Accordingly, research on a heating-type aerosol generating article or a heating-type aerosol generating device has been actively conducted.

DISCLOSURE OF INVENTION

Technical Problem

Aerosol generating devices may provide a function of operating a heater by detecting whether an aerosol generating article is inserted, and provide a function of compensating for a temperature of the heater that is momentarily lowered due to puff generation by detecting whether a user's puff has occurred. However, when separate sensors are provided to detect whether an aerosol generating article is inserted into an aerosol generating apparatus and whether a user's puff has occurred, restrictions to be considered during design increase in order for each sensor to properly perform functions, and thus, it may be difficult to reduce the size of aerosol generating apparatuses.

The technical problem to be solved by the present embodiment is not limited to the technical problem described above, and other technical problems may be inferred from the following embodiments.

Solution to Problem

According to an aspect of the present disclosure, there are provided aerosol generating apparatuses capable of determining whether an aerosol generating article is inserted and whether a user's puff has occurred by using a single sensor, instead of including a sensor for determining whether the aerosol generating article is inserted and a sensor for determining whether a user's puff has occurred.

According to an aspect of the present disclosure, an aerosol generating apparatus includes an accommodation portion configured to accommodate an aerosol generating article, a pressure sensor configured to detect pressure in the accommodation portion, and a controller configured to determine whether the aerosol generating article is inserted into or removed from the accommodation portion and whether a user's puff has occurred on the aerosol generating article, based on whether pressure detected by the pressure sensor is increased or reduced from a reference value.

Advantageous Effects of Invention

Embodiments of the present disclosure may include an aerosol generating apparatus including a pressure sensor. Specifically, the aerosol generating apparatus according to a non-limiting example embodiment may determine whether an aerosol generating article is inserted into or removed from an accommodation portion and whether a users puff has occurred, based on whether pressure detected by a pressure sensor for detecting pressure in the accommodation portion is increased or reduced from a reference value.

Accordingly, a single sensor is used, instead of including a sensor for determining whether an aerosol generating article is inserted into or removed from an aerosol generating apparatus and a sensor for determining whether a user's puff has occurred, and thus, the aerosol generating apparatus may be reduced in size.

Effects of embodiments of the present disclosure are not limited to the above description, and more various effects may be provided by embodiments of the present disclosure.

BRIEF DESCRIPTION OF DRAWINGS

FIG. 1 is a view illustrating an example in which an aerosol generating article is inserted into an aerosol generating apparatus, according to an embodiment.

FIG. 2 is a view illustrating an example in which an aerosol generating article is inserted into an aerosol generating apparatus, according to an embodiment.

FIG. 3 is a view illustrating an example in which an aerosol generating article is inserted into an aerosol generating apparatus, according to an embodiment.

FIG. 4 is a view illustrating an example of an aerosol generating article.

FIG. 5 is a view illustrating a configuration of an aerosol generating apparatus according to an embodiment.

FIG. 6 is a view illustrating a configuration of an aerosol generating apparatus according to another embodiment.

FIG. 7 is a diagram illustrating an example of determining whether an aerosol generating article is removed from an accommodation portion of an aerosol generating apparatus.

FIG. 8 is a diagram illustrating an example of determining whether a user's puff has occurred.

FIG. 9 is a diagram illustrating an example to determine whether a puff has occurred and whether an aerosol generating article is inserted into an accommodation portion of an aerosol generating apparatus.

FIG. 10A illustrates a first diagram of another example of determining whether an aerosol generating article is removed from an accommodation portion of an aerosol generating apparatus.

FIG. 10B illustrates a second diagram of the another example of determining whether the aerosol generating article is removed from the accommodation portion of the aerosol generating apparatus.

FIG. 11 is a diagram illustrating another example of determining whether an aerosol generating article is removed from an accommodation portion of an aerosol generating apparatus.

FIG. 12 is a diagram illustrating another example of determining whether a user's puff has occurred.

MODE FOR THE INVENTION

With respect to the terms used to describe the various embodiments, general terms which are currently and widely used are selected in consideration of functions of structural elements in the various embodiments of the present disclosure. However, meanings of the terms can be according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used to describe the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

Ordinal terms as used in the present disclosure, such as first and second may be used to describe various components, not limiting the components. These expressions are used to distinguish one component from another component.

Hereinafter, the present disclosure will now be described more fully with reference to the accompanying drawings, in which non-limiting example embodiments of the present disclosure are described such that one of ordinary skill in the art may easily work the present disclosure. The embodiments of the disclosure may, however, be embodied in many different forms and should not be construed as being limited to the example embodiments set forth herein.

FIGS. 1 through 3 are diagrams showing examples in which an aerosol generating article is inserted into an aerosol generating apparatus.

Referring to FIGS. 1 to 3, an aerosol generating system 100 includes an aerosol generating apparatus 1 and an aerosol generating article 2 that is inserted into the aerosol generating apparatus 1.

Referring to FIG. 1, the aerosol generating apparatus 1 may include a battery 11, a controller 12, and a heater 13. Referring to FIGS. 2 and 3, the aerosol generating apparatus 1 may further include a vaporizer 14. Also, the aerosol generating article 2 may be inserted into an inner space of the aerosol generating apparatus 1.

FIGS. 1 through 3 illustrate components of the aerosol generating apparatus 1, which are related to the present embodiment. Therefore, it will be understood by one of ordinary skill in the art related to the present embodiment that other general-purpose components may be further included in the aerosol generating apparatus 1, in addition to the components illustrated in FIGS. 1 through 3.

Also, FIGS. 2 and 3 illustrate that the aerosol generating apparatus 1 includes the heater 13. However, according to some embodiments, the heater 13 may be omitted.

In addition, the aerosol generating apparatus 1 illustrated in FIGS. 2 and 3 includes the vaporizer 14. However, the structures of the aerosol generating apparatus according to embodiments of the present disclosure are not limited, and the vaporizer 14 may not be included in the aerosol generating apparatus 1. In a state where the vaporizer 14 is not included in the aerosol generating apparatus 1, when the aerosol generating article 2 is heated by the heater 13, the aerosol generating article 2 may generate an aerosol.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating apparatus 1 is not limited to the structures illustrated in FIGS. 1 through 3. In other words, according to the design of the aerosol generating apparatus 1, the battery 11, the controller 12, the heater 13, and the vaporizer 14 may be differently arranged.

When the aerosol generating article 2 is inserted into the aerosol generating apparatus 1, the aerosol generating apparatus 1 may operate the heater 13 and/or the vaporizer 14 to generate aerosol from the aerosol generating article 2 and/or the vaporizer 14. The aerosol generated by the heater 13 and/or the vaporizer 14 is delivered to a user by passing through the aerosol generating article 2.

According to some embodiments, even when the aerosol generating article 2 is not inserted into the aerosol generating apparatus 1, the aerosol generating apparatus 1 may heat the heater 13.

The battery 11 may supply power to be used for the aerosol generating apparatus 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating apparatus 1.

The controller 12 may generally control operations of the aerosol generating apparatus 1. In detail, the controller 12 may control not only operations of the battery 11, the heater 13, and the vaporizer 14, but also operations of other components included in the aerosol generating apparatus 1. Also, the controller 12 may check a state of each of the components of the aerosol generating apparatus 1 to determine whether the aerosol generating apparatus 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the aerosol generating article is inserted into the aerosol generating apparatus 1, the heater 13 may be located outside the aerosol generating article. Thus, the heated heater 13 may increase a temperature of an aerosol generating material in the aerosol generating article.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating apparatus 1 or may be set as a temperature desired by a user.

As another example, the heater 13 may include an induction heater. In detail, the heater 13 may include an electrically conductive coil for heating an aerosol generating article in an induction heating method, and the aerosol generating article may include a susceptor which may be heated by the induction heater.

For example, the heater 13 may include a tube-type heating element, a plate-type heating element, a needle-type heating element, or a rod-type heating element, and may heat the inside or the outside of the aerosol generating article 2, according to the shape of the heating element.

Also, the aerosol generating apparatus 1 may include a plurality of the heater 13. Here, the plurality of the heater 13 may be inserted into the aerosol generating article 2 or may be arranged outside the aerosol generating article 2. Also, some of the plurality of the heater 13 may be inserted into the aerosol generating article 2 and the others may be arranged outside the aerosol generating article 2. In addition, the shape of the heater 13 is not limited to the shapes illustrated in FIGS. 1 through 3 and may include various shapes.

The vaporizer 14 may generate aerosol by heating a liquid composition and the generated aerosol may pass through the aerosol generating article 2 to be delivered to a user. In other words, the aerosol generated via the vaporizer 14 may move along an airflow passage of the aerosol generating apparatus 1 and the airflow passage may be configured such that the aerosol generated via the vaporizer 14 passes through the aerosol generating article to be delivered to the user.

For example, the vaporizer 14 may include a liquid storage, a liquid delivery element, and a heating element, but it is not limited thereto. For example, the liquid storage, the liquid delivery element, and the heating element may be included in the aerosol generating apparatus 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating apparatus 1 may further include general-purpose components in addition to the battery 11, the controller 12, the heater 13, and the vaporizer 14. For example, the aerosol generating apparatus 1 may include a display capable of outputting visual information and/or a motor for outputting haptic information. Also, the aerosol generating apparatus 1 may include at least one sensor (a puff detecting sensor, a temperature detecting sensor, an aerosol generating article insertion detecting sensor, etc.). Also, the aerosol generating apparatus 1 may be formed as a structure that, even when the aerosol generating article 2 is inserted into the aerosol generating apparatus 1, may introduce external air or discharge internal air.

Although not illustrated in FIGS. 1 through 3, the aerosol generating apparatus 1 and an additional cradle may form together a system. For example, the cradle may be used to charge the battery 11 of the aerosol generating apparatus 1. Alternatively, the heater 13 may be heated when the cradle and the aerosol generating apparatus 1 are coupled to each other.

The aerosol generating article 2 may be similar to a general combustive aerosol generating article. For example, the aerosol generating article 2 may be divided into a first portion including an aerosol generating material and a second portion including a filter, etc. Alternatively, the second portion of the aerosol generating article 2 may also include an aerosol generating material. For example, an aerosol generating material made in the form of granules or capsules may be inserted into the second portion.

The entire first portion may be inserted into the aerosol generating apparatus 1, and the second portion may be exposed to the outside. Alternatively, only a portion of the first portion may be inserted into the aerosol generating apparatus 1, or the entire first portion and a portion of the second portion may be inserted into the aerosol generating apparatus 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating apparatus 1. For example, opening and closing of the air passage and/or a size of the air passage formed in the aerosol generating apparatus 1 may be adjusted by the user. Accordingly, the amount of smoke and a smoking impression may be adjusted by the user. As another example, the external air may flow into the aerosol generating article 2 through at least one hole formed in a surface of the aerosol generating article 2.

Hereinafter, an example of the aerosol generating article 2 will be described with reference to FIG. 4.

FIG. 4 illustrates an example of the aerosol generating article.

Referring to FIG. 4, the aerosol generating article 2 may include a tobacco rod 21 and a filter rod 22. The first portion described above with reference to FIGS. 1 through 3 may include the tobacco rod 21, and the second portion may include the filter rod 22.

FIG. 4 illustrates that the filter rod 22 includes a single segment. However, the filter rod 22 is not limited thereto. In other words, the filter rod 22 may include a plurality of segments. For example, the filter rod 22 may include a first segment configured to cool an aerosol and a second segment configured to filter a certain component included in the aerosol. Also, according to embodiments, the filter rod 22 may further include at least one segment configured to perform other functions.

The aerosol generating article 2 may be packaged using at least one wrapper 24. The wrapper 24 may have at least one hole through which external air may be introduced or internal air may be discharged. For example, the aerosol generating article 2 may be packaged by one wrapper 24. As another example, the aerosol generating article 2 may be doubly packaged by two or more of the wrapper 24. For example, the tobacco rod 21 may be packaged by a first wrapper, and the filter rod 22 may be packaged by a second wrapper. Also, the tobacco rod 21 and the filter rod 22, which are respectively packaged by separate wrappers, may be coupled to each other, and the entire aerosol generating article 2 may be packaged by a third wrapper. When each of the tobacco rod 21 or the filter rod 22 is composed of a plurality of segments, each segment may be packaged by separate wrappers. Also, the entire aerosol generating article 2 including the plurality of segments, which are respectively packaged by the separate wrappers and which are coupled to each other, may be re-packaged by another wrapper.

The tobacco rod 21 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21 may include other additives, such as flavors, a wetting agent, and/or organic acid. Also, the tobacco rod 21 may include a flavored liquid, such as menthol or a moisturizer, which is injected to the tobacco rod 21.

The tobacco rod 21 may be manufactured in various forms. For example, the tobacco rod 21 may be formed as a sheet or a strand. Also, the tobacco rod 21 may be formed as a pipe tobacco, which is formed of tiny bits cut from a tobacco sheet. Also, the tobacco rod 21 may be surrounded by a heat conductive material. For example, the heat-conducting material may be, but is not limited to, a metal foil such as aluminum foil. For example, the heat conductive material surrounding the tobacco rod 21 may uniformly distribute heat transmitted to the tobacco rod 21, and thus, the heat conductivity applied to the tobacco rod may be increased and taste of the tobacco may be improved. Also, the heat conductive material surrounding the tobacco rod 21 may function as a susceptor heated by the induction heater. Here, although not illustrated in the drawings, the tobacco rod 21 may further include an additional susceptor, in addition to the heat conductive material surrounding the tobacco rod 21.

The filter rod 22 may include a cellulose acetate filter. Shapes of the filter rod 22 are not limited. For example, the filter rod 22 may include a cylinder-type rod or a tube-type rod having a hollow inside. Also, the filter rod 22 may include a recess-type rod. When the filter rod 22 includes a plurality of segments, at least one of the plurality of segments may have a different shape.

The filter rod 22 may be formed to generate flavors. For example, a flavoring liquid may be injected onto the filter rod 22, or an additional fiber coated with a flavoring liquid may be inserted into the filter rod 22.

Also, the filter rod 22 may include at least one capsule 23. Here, the capsule 23 may generate a flavor or an aerosol. For example, the capsule 23 may have a configuration in which a liquid containing a flavoring material is wrapped with a film. For example, the capsule 23 may have a spherical or cylindrical shape, but is not limited thereto.

When the filter rod 22 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Meanwhile, although not illustrated in FIG. 4, the aerosol generating article 2 according to an embodiment may further include a front-end filter. The front-end filter may be located on one side of the tobacco rod 21 which is opposite to the filter rod 22. The front-end filter may prevent the tobacco rod 21 from being detached outwards and prevent the liquefied aerosol from flowing from the tobacco rod 21 into the aerosol generating apparatus (not illustrated), during smoking.

FIG. 5 is a view illustrating a configuration of an aerosol generating apparatus according to an embodiment.

Referring to FIG. 5, an aerosol generating apparatus 5 may include a pressure sensor 53. The aerosol generating apparatus 5, a battery 51, a controller 52, a heater 54, and a cigarette 56 illustrated in FIG. 5 correspond to the aerosol generating apparatus 1, the battery 11, the controller 12, the heater 13, and the aerosol generating article 2 illustrated in FIGS. 1 to 3, respectively, and thus, redundant description is omitted. The cigarette 56 may be an example of an aerosol generating article.

In one embodiment, the pressure sensor 53 may detect pressure in the accommodation portion that accommodates the cigarette 56. For example, the pressure sensor 53 may detect a change in pressure in the accommodation portion due to a change in airflow passing through an airflow passage 55 in the accommodation portion.

The airflow passage 55 may be a passage through which air flows from the outside of the aerosol generating apparatus 5 to the inside thereof or may be a passage through which air is discharged from the inside of the aerosol generating apparatus 5 to the outside thereof. When the cigarette 56 is inserted into or removed from the accommodation portion, air may move through the airflow passage 55. In addition, even when a user's puff has occurred, air may move through the airflow passage 55.

A change in pressure may be caused by a change in airflow when the cigarette 56 is inserted into the accommodation portion or the cigarette 56 is removed from the accommodation portion. Meanwhile, the pressure sensor 53 may output a reference value in a state where there is no change in airflow (for example, an initial state). In one embodiment, when the cigarette 56 is inserted into the accommodation portion, the pressure sensor 53 may output pressure reduced from the reference value. In another embodiment, when the cigarette 56 is removed from the accommodation portion, the pressure sensor 53 may output pressure increased from the reference value.

In addition, a direction of the change in pressure output from the pressure sensor 53 depending on whether the cigarette 56 is inserted into or removed from the accommodation portion is only an example, and embodiments of the present disclosure are not limited thereto. The direction of the change in pressure may change depending on a structure or arrangement of the pressure sensor 53. For example, the pressure sensor 53 may output pressure increased from the reference value when the cigarette 56 is inserted into the accommodation portion and may output pressure reduced from the reference value when the cigarette 56 is removed from the accommodation portion.

In addition, the change in pressure may occur even when a user puffs. When the user puffs the cigarette 56, air in the accommodation portion may be discharged to the outside through the cigarette 56, and thus, the pressure in the accommodation portion may be reduced. Accordingly, the pressure sensor 53 may output pressure reduced from the reference value.

The reference value is a criterion for determining an increase or decrease in pressure in the accommodation portion and may be set previously. For example, 1 atm at 0° C. may be set as the reference value, or 1 atm at 25° C. may be set as the reference value. In another example, a range of 0.9 to 1.1 atm at 0° C. may be set as the reference value, but the present disclosure is not limited thereto. The reference value may be a fixed value or a variable value. The reference value may be adjusted in real time based on an ambient pressure. For example, when a user uses the aerosol generating apparatus 5 in an alpine area, the reference value may be set to be lower than when the user is in a flat area.

When the cigarette 56 is inserted into the accommodation portion, a change in pressure may occur due to an airflow passing through the airflow passage 55, and the pressure sensor 53 may output pressure reduced from the reference value. For example, in a case where the reference value is 101300 Pa, when the cigarette 56 is inserted into the accommodation portion, the pressure sensor 53 may output 101070 Pa which is reduced by 230 Pa from the reference value.

When the cigarette 56 is removed from the accommodation portion, a change in pressure may occur due to an airflow passing through the airflow passage 55, and the pressure sensor 53 may output pressure increased from the reference value. For example, in a case where the reference value is 101300 Pa, when the cigarette 56 is removed from the accommodation portion, the pressure sensor 53 may output 101590 Pa which is increased by 290 Pa from the reference value.

When a user puffs, a change in pressure may occur due to an airflow passing through the airflow passage 55, and the pressure sensor 53 may output pressure reduced from the reference value. For example, in a case where the reference value is 101300 Pa, when a user's puff has occurred, the pressure sensor 53 may output 100390 Pa which is reduced by 910 Pa from the reference value.

In one embodiment, the controller 52 may determine whether the cigarette 56 is inserted into or removed from the accommodation portion and whether a user's puff has occurred, based on whether the pressure detected by the pressure sensor 53 is increased or reduced from the reference value.

For example, when a difference value obtained by subtracting the reference value from the pressure detected by the pressure sensor 53 is greater than or equal to a first threshold, the controller 52 may determine that the cigarette 56 is removed from the accommodation portion. In another example, when the difference value obtained by subtracting the reference value from the pressure detected by the pressure sensor 53 is less than or equal to a second threshold, the controller 52 may determine that the user's puff has occurred. In another example, when the pressure detected by the pressure sensor 53 has a value less than the reference value and a difference value obtained by subtracting the reference value from the pressure detected by the pressure sensor 53 is greater than the second threshold and less than or equal to a third threshold, the controller 52 may determine that the cigarette 56 is inserted into the accommodation portion.

When it is determined that the cigarette 56 is inserted into the accommodation portion or that a user's puff has occurred, the controller 52 may control the heater 54 to heat the cigarette 56.

In one embodiment, when it is determined that the cigarette 56 is inserted into the accommodation portion based on whether pressure detected by the pressure sensor 53 is increased or reduced from the reference value, the controller 52 may control the heater 54 to heat the cigarette 56. For example, when it is determined that the cigarette 56 is inserted into the accommodation portion, the controller 52 may control the heater 54 to heat the cigarette 56 after 5 seconds.

In addition, when it is determined that the cigarette 56 is inserted into the accommodation portion based on whether the pressure detected by the pressure sensor 53 is increased or reduced from the reference value, and when it is determined that a user's puff has occurred more than a preset number of times, the controller 52 may control the heater 54 to heat the cigarette 56. For example, when it is determined that the cigarette 56 is inserted into the accommodation unit, and when a user puff has occurred two or more times, the controller 52 may control the heater 54 to heat the cigarette 56.

The aerosol generating apparatus 5 may include a plurality of heaters. The plurality of heaters may be two or three heaters or may be more than three heaters. The plurality of heaters may have different aerosol generating articles to be heated from each other or different times for heating the aerosol generating articles from each other. For example, among the plurality of heaters, a first heater heats the cigarette 56 when it is determined that the cigarette 56 is inserted into the accommodation portion, and a second heater may heat another aerosol generating article (for example, a cartridge) other than the cigarette 56 when it is determined that a user's puff has occurred, but embodiments of the present disclosure are not limited thereto.

In one embodiment, after it is determined that the cigarette 56 is inserted into the accommodation portion, when it is determined that the user's puff has occurred within a preset time, the heater 54 may control the cigarette 56 to heat the cigarette 56. For example, in a case where the preset time is 5 seconds, and after it is determined that the cigarette 56 is inserted into the accommodation portion, when it is determined that the user's puff has occurred within 5 seconds, the controller 52 may control the heater 54 to heat the cigarette 56. In a case where the preset time is 5 seconds, after it is determined that the cigarette 56 is inserted into the accommodation portion, and when it is not determined that the user's puff has occurred within 5 seconds, the controller 52 may control the heater 54 so as not to heat the cigarette 56.

When it is determined that the cigarette 56 is inserted into the accommodation portion, the controller 52 may control the heater 54 to heat the cigarette 56. In addition, after it is determined that the cigarette 56 is inserted into the accommodation portion, when it is determined that the user's puff has occurred within the preset time, the controller 52 may maintain a heating operation of the heater 54, and when it is not determined that the user's puff has occurred within the preset time, the controller 52 may stop the heating operation of the heater 54.

When it is determined that the cigarette 56 is inserted into the accommodation portion, the controller 52 may control the heater 54 to heat the cigarette 56, and after it is determined that the cigarette 56 is inserted into the accommodation portion, when it is determined that the user's puff has occurred within the preset time, the controller 52 may maintain the heating operation of the heater 54. In addition, when the user's puff is repeated and the accumulated number of puffs exceeds a preset number, the controller 52 may stop the heating operation of the heater 54

In addition, in the above-described embodiments, numerical values such as 5 seconds and 14 number of times are only examples, and embodiments of the present disclosure are not limited thereto, and the numerical values may be changed to any appropriate values.

FIG. 6 is a diagram illustrating a configuration of an aerosol generating apparatus according to another embodiment.

Referring to FIG. 6, an aerosol generating apparatus 6 may include a cartridge 66 that is detachably coupled to a main body 67. The aerosol generating apparatus 6, a battery 61, a controller 62, a pressure sensor 63, a heater 64, and an airflow passage 65 illustrated in FIG. 6 correspond to the aerosol generating apparatus 5, the battery 51, the controller 52, the pressure sensor 53, the heater 54, and the airflow passage 55 illustrated in FIG. 5, respectively, and the cartridge 66 illustrated in FIG. 6 corresponds to the vaporizer 14 illustrated in FIG. 2 or 3, and thus, redundant description is omitted. The cartridge 66 may be an example of an aerosol generating article.

The aerosol generating apparatus 6 according to the embodiment illustrated in FIG. 6 may include the cartridge 66 for holding an aerosol generating material, and the main body 67 for supporting the cartridge 66.

The cartridge 66 may be coupled to the main body 67 in a state of accommodating an aerosol generating material therein. As a portion of the cartridge 66 is inserted into the accommodation portion (not illustrated) of the main body 67, the cartridge 66 may be mounted on the main body 67.

A mouthpiece may be coupled to one end of the cartridge 66. The mouthpiece is a portion of the aerosol generating apparatus 6 which is inserted into the mouth of a user. The mouthpiece may discharge an aerosol generated from the aerosol generating material included in a liquid storage to the outside.

In one embodiment, the aerosol generating apparatus 6 may include only the main body 67, and in this case, hardware components of the aerosol generating apparatus 6 may be included in the main body 67. In another embodiment, the aerosol generating apparatus 6 may include the main body 67 and the cartridge 66, and the hardware components included in the aerosol generating apparatus 6 may be included in the main body 67 and the cartridge 66. Alternatively, at least some of the hardware components included in the aerosol generating apparatus 6 may be included in the main body 67 and the cartridge 66.

When the aerosol generating apparatus 6 is composed of the main body 67 and the cartridge 66, the heater 64 may be included in the cartridge 66. When the heater 64 is included in the cartridge 66, the heater 64 may receive power from the battery 61 included in the main body 67.

In one embodiment, the heater 64 may be included in the cartridge 66. The cartridge 66 may include the heater 64, a liquid delivery unit and a liquid storage. An aerosol generating material accommodated in the liquid storage may move to the liquid delivery unit, and the heater 64 may heat the aerosol generating material absorbed by the liquid delivery unit, and thus, an aerosol may be generated. For example, the heater 64 may include a material such as nickel chromium and may be wound around the liquid delivery unit or arranged adjacent to the liquid delivery unit.

In one embodiment, the pressure sensor 63 may sense the pressure inside the accommodation portion accommodating the cartridge 66. For example, the pressure sensor may detect a change in pressure in the accommodation portion due to a change in airflow passing through the airflow passage 65 in the accommodation portion.

When the cartridge 66 is inserted into or removed from the accommodation portion, air may move through the airflow passage 65. In addition, even when a user's puff has occurred, air may move through the airflow passage 65.

A change in pressure may be caused by a change in airflow when the cartridge 66 is inserted into the accommodation portion or the cartridge 66 is removed from the accommodation portion. In addition, the pressure sensor 63 is set to output a reference value in a state where there is no change in airflow (for example, an initial state), and thus, when the cartridge 66 is inserted into the accommodation portion, the pressure sensor 63 may output pressure reduced from the reference value. When the cartridge 66 is removed from the accommodation portion, the pressure sensor 63 may output pressure increased from the reference value.

In addition, a direction in which the pressure output from the pressure sensor 63 changes depending on whether the cartridge 66 is inserted into or removed from the accommodation portion is only an example, and embodiments of the present disclosure are not limited thereto. A direction of the change in pressure may change depending on a structure or arrangement of the pressure sensor 63. For example, the pressure sensor 63 may output pressure increased from the reference value when the cartridge 66 is inserted into the accommodation portion, and may output pressure reduced from the reference value when the cartridge 66 is removed from the accommodation portion.

In addition, the change in pressure may occur even when a user puffs. When the user puffs the cartridge 66, air in the accommodation portion is discharged to the outside through the airflow passage 65, and thereby, pressure in the accommodation portion may be reduced. Accordingly, the pressure sensor 63 may output pressure reduced from the reference value.

When the cartridge 66 is inserted into the accommodation portion and coupled to the main body 67, a change in pressure may occur due to an airflow passing through the airflow passage 65, and the pressure sensor 63 may output pressure reduced from the reference value. For example, in a case where the reference value is 101300 Pa, when the cartridge 66 is inserted into the accommodation portion, the pressure sensor 63 may output 101070 Pa which is reduced by 230 Pa from the reference value.

When the cartridge 66 is removed from the accommodation portion to be separated from the main body 67, a change in pressure may occur due to an airflow passing through the airflow passage 65, and the pressure sensor 63 may output pressure increased from the reference value. For example, in a case where the reference value is 101300 Pa, when the cartridge 66 is removed from the accommodation portion, the pressure sensor 63 may output 101590 Pa which is increased by 290 Pa from the reference value.

When a user puffs, a change in pressure may occur due to an airflow passing through the airflow passage 65, and the pressure sensor 63 may output pressure reduced from the reference value. For example, in a case where the reference value is 101300 Pa, when a user's puff has occurred, the pressure sensor 63 may output 100390 Pa which is reduced by 910 Pa from the reference value.

In one embodiment, the controller 62 may determine whether the cartridge 66 is inserted into the accommodation portion and whether a user puffs the cartridge 66 based on whether pressure detected by the pressure sensor 63 is greater than or less than the reference value.

For example, when a difference value obtained by subtracting the reference value from the pressure detected by the pressure sensor 63 is greater than or equal to the first threshold, the controller 62 may determine that the cartridge 66 is removed from the accommodation portion. In another example, when the difference value obtained by subtracting the reference value from the pressure detected by the pressure sensor 63 is less than or equal to the second threshold, the controller 62 may determine that a user's puff has occurred on the cartridge 66. In another example, when the difference value obtained by subtracting the reference value from the pressure detected by the pressure sensor 63 is greater than the second threshold and less than or equal to the third threshold, the controller 62 may determines that the cartridge 66 is inserted into the accommodation portion.

The controller 62 may control the heater 64 to heat the cartridge 66 when it is determined that the cartridge 66 is inserted into the accommodation portion or when it is determined that a user's puff has occurred.

The controller 62 may control the heater 64 to heat the cartridge 66 when it is determined that a user's puff has occurred within a preset time after it is determined that the cartridge 66 is inserted into the accommodation portion. For example, in a case where the preset time is 5 seconds, when it is determined that the user's puff has occurred within 5 seconds after it is determined that the cartridge 66 is inserted into the accommodation portion, the controller 62 may control the heater 64 to heat the cartridge 66, and embodiments of the present disclosure are not limited thereto.

When it is determined that the cartridge 66 is inserted into the accommodation portion, the controller 62 may control the heater 64 to heat the cartridge 66. In addition, when it is determined that a user's puff has occurred within a preset time after it is determined that the cartridge 66 is inserted into the accommodation portion, the controller 62 may maintain a heating operation of the heater 64, and when it is not determined that the user's puff has occurred within the preset time, the controller 62 may stop the heating operation of the heater 64.

Hereinafter, a process of determining whether an aerosol generating article is inserted into an accommodation portion and whether a user's puff has occurred on the aerosol generating article by using an aerosol generating apparatus will be described in detail below with reference to FIGS. 7 to 12.

FIG. 7 is a diagram illustrating an example of determining whether an aerosol generating article is removed from an accommodation portion of an aerosol generating apparatus.

A horizontal axis of a graph illustrated in FIG. 7 may indicate a time t at which a change in pressure occurs, and a vertical axis may indicate a difference value P obtained by subtracting a reference value from pressure detected by a pressure sensor (for example, the pressure sensor 53 of FIG. 5 or the pressure sensor 63 of FIG. 6).

The pressure sensor may detect pressure in the accommodation portion accommodating the aerosol generating article and may output a value corresponding to the pressure in the accommodation portion. The pressure detected by the pressure sensor may be a value increased or reduced from the reference value.

A controller (for example, the controller 52 of FIG. 5 or the controller 62 of FIG. 6) may determine whether the aerosol generating article is removed from the accommodation portion based on whether the pressure detected by the pressure sensor is greater than or less than the reference value.

In one embodiment, when a difference value obtained by subtracting the reference value from the pressure detected by the pressure sensor is greater than or equal to a first threshold, the controller may determine that the aerosol generating article is removed from the accommodation portion. The first threshold may indicate a value for determining that the aerosol generating article is removed from the accommodation portion. When the aerosol generating article is removed from the accommodation portion, the pressure in the accommodation portion may increase, and the pressure detected by the pressure sensor may have a value greater than the reference value. The difference value obtained by subtracting the reference value from the pressure detected by the pressure sensor may be a positive value, and the first threshold may also be a positive number. When the difference value obtained by subtracting the reference value from the pressure detected by the pressure sensor is greater than the first threshold, it may be determined that the aerosol generating article is removed from the accommodation portion.

The first threshold may be in a range of 150 Pa to 250 Pa. For example, the first threshold may be 200 Pa but is not limited thereto.

For example, in a case where the first threshold is 200 Pa and the reference value is 100410 Pa, when the pressure detected by the pressure sensor is 100700 Pa, a difference value obtained by subtracting the reference value from the pressure detected by the pressure sensor may be 290 Pa. Therefore, the difference value is greater than or equal to the first threshold, the controller may determine that the aerosol generating article is removed from the accommodation portion. In another example, in a case where the first threshold is 160 Pa and the reference value is 100310 Pa, when the pressure detected by the pressure sensor is 100650 Pa, the difference value obtained by subtracting the reference value from the pressure detected by the pressure sensor may be 340 Pa. Therefore, the difference value is greater than or equal to the first threshold, the controller may determine that the aerosol generating article is removed from the accommodation portion.

In addition, in the above-described embodiment, an example in which a pressure sensor detects pressure in an accommodation portion and a controller calculates a difference value between pressure output from a pressure sensor and a reference value is described, but embodiments of the present disclosure are not limited thereto. In another embodiment, the pressure sensor may also output a value (difference value) corresponding to pressure greater than or less than a reference value other than a value corresponding to internal pressure of the accommodation portion. When the pressure in the accommodation portion is increased from the reference value, the pressure sensor may output pressure increased from the reference value as a positive value. In addition, when the pressure in the accommodation portion is reduced from the reference value, the pressure sensor may output pressure reduced from the reference value as a negative value. When a value corresponding to pressure reduced from the reference value is greater than or equal to the first threshold, the controller may determine that the aerosol generating article is removed from the accommodation portion.

By setting a threshold, a change in pressure due to insertion or removal of the aerosol generating article and a change in pressure due to a user's puff may be distinguished, and a change in pressure not due to the insertion or removal of the aerosol generating article, a change in pressure not due to the user's puff, noise, and so on may be filtered out.

The threshold may be a fixed value or a variable value. When the reference value is changed, the threshold may be changed according to the reference value. For example, when the reference value is set to be lower than atmospheric pressure due to a change in environment, the threshold may be set as low as the reference value. In another example, the threshold may be changed according to a puff profile of a user but is not limited to the above-described example.

FIG. 8 is a diagram illustrating an example of determining whether a user's puff has occurred.

A horizontal axis of a graph of FIG. 8 may indicate the time t at which a change in pressure occurs, and a vertical axis may indicate the difference value P obtained by subtracting the reference value from pressure detected by a pressure sensor. In addition, FIG. 8 is continued from FIG. 7, and thus, redundant description is omitted.

The controller may determine whether a user's puff has occurred on the aerosol generating article based on whether the pressure detected by the pressure sensor is increased or reduced from the reference value.

In one embodiment, when a difference value obtained by subtracting the reference value from the pressure detected by the pressure sensor is less than or equal to the second threshold, the controller may determine that the user's puff has occurred. The second threshold may indicate a value for determining that the user's puff has occurred. When the user's puff has occurred, the pressure in the accommodation portion may decrease, and the pressure detected by the pressure sensor may have a value less than the reference value. The difference value obtained by subtracting the reference value from the pressure detected by the pressure sensor may be a negative value, and the second threshold may also be a negative number. When the difference value obtained by subtracting the reference value from the pressure detected by the pressure sensor is less than the second threshold, it may be determined that the user's puff has occurred.

The second threshold may be in a range of −1200 Pa to −800 Pa. For example, the second threshold may be −1000 Pa but is not limited thereto.

For example, in a case where the second threshold is −1000 Pa and the reference value is 100410 Pa, when the pressure detected by the pressure sensor is 99400 Pa, the difference value obtained by subtracting the reference value from the pressure detected by the pressure sensor may be −1010 Pa. Therefore, the difference value corresponds to a value less than or equal to the second threshold, and thus, the controller may determine that the user's puff has occurred. In another example, in a case where the second threshold is −900 Pa and the reference value is 100410 Pa, when the pressure detected by the pressure sensor is 99600 Pa, the difference value obtained by subtracting the reference value from the pressure detected by the pressure sensor may be −810 Pa. Therefore, the difference value does not correspond to a value less than or equal to the second threshold, and the controller may determine that the user's puff is not made.

In addition, in the above-described embodiment, an example in which a pressure sensor detects pressure in an accommodation portion and a controller calculates a difference value between pressure output from the pressure sensor and a reference value is described, but embodiments of the present disclosure are not limited thereto. In another embodiment, the pressure sensor may also output a value corresponding to the pressure increased or reduced from the reference value other than a value corresponding to an internal pressure of the accommodation portion. When the pressure in the accommodation portion is increased from the reference value, the pressure sensor may output pressure increased from the reference value as a positive value. In addition, when the pressure in the accommodation portion is less than the reference value, the pressure sensor may output pressure reduced from the reference value as a negative value. When a value corresponding to the pressure reduced from the reference value is less than or equal to the second threshold, the controller may determine that the user's puff has occurred.

FIG. 9 is a diagram illustrating an example to determine whether a puff has occurred and whether an aerosol generating article is inserted into an accommodation portion of an aerosol generating apparatus.

A horizontal axis of a graph illustrated in FIG. 9 may indicate the time t at which a change in pressure occurs, and a vertical axis may indicate the difference value P obtained by subtracting a reference value from pressure detected by a pressure sensor. In addition, FIG. 9 is continued from FIG. 8, and thus, redundant description is omitted.

In one embodiment, when a difference value obtained by subtracting the reference value from the pressure detected by the pressure sensor is less than or equal to the second threshold, it may be determined that user's puff has occurred, and when the difference value is greater than the second threshold and less than or equal to a third threshold, it may be determined that the aerosol generating article is inserted into the accommodation portion. In addition, the third threshold may indicate a value for determining that the aerosol generating article is inserted into the accommodation portion, and the third threshold may be a negative number. The third threshold may have a smaller absolute value than the second threshold.

The third threshold may be in a range of −250 Pa to −150 Pa. For example, the third threshold may be −200 Pa but is not limited thereto.

For example, when the second threshold is −1000 Pa and the third threshold is −200 Pa and the pressure detected by the pressure sensor is 100200 Pa and the reference value is 101300 Pa, a difference value obtained by subtracting the reference value from the pressure detected by the pressure sensor may be −1100 Pa. Therefore, the difference value corresponds to a value less than or equal to the second threshold, and thus, the controller may determine that user's puff has occurred. In another example, when the second threshold is −1000 Pa and the third threshold is −200 Pa and the pressure detected by the pressure sensor is 100700 Pa and the reference value is 101300 Pa, the difference value may be −600 Pa. Therefore, the difference value corresponds to a value greater than the second threshold and less than or equal to the third threshold, the controller may determine that the aerosol generating article is inserted into the accommodation portion and may determine that the user's puff is not made.

As such, when the aerosol generating article is inserted into the accommodation portion and when user's puff has occurred, the pressure in the accommodation portion is reduced, and thus, two or more thresholds may be used to distinguish each case. In addition, when the controller distinguishes between whether the aerosol generating article is inserted into the accommodation portion and whether user's puff has occurred only by using the thresholds, there is a possibility that an error may occur. For example, there is a period in which the difference value obtained by subtracting the reference value from the pressure detected by the pressure sensor is greater than the second threshold and less than or equal to the third threshold even during a process in which the pressure in the accommodation portion is reduced as a user's puff occurs. Therefore, the controller may consider a time at which the pressure detected by the pressure sensor is maintained in addition to the thresholds to more accurately distinguish between whether the aerosol generating article is inserted into the accommodation portion and whether a user's puff has occurred.

In one embodiment, the controller may withdraw the determination that the aerosol generating article is inserted, when a state in which the difference value obtained by subtracting the reference value from the pressure detected by the pressure sensor is greater than the second threshold and less than or equal to the third threshold is maintained for a preset time or more.

For example, in a case where the second threshold is −1000 Pa, the third threshold is −200 Pa, and the reference value is 101300 Pa, when a state in which the difference value is between −800 Pa and −500 Pa is continued for 0.5 seconds or more, the controller may withdraw the determination that the aerosol generating article is inserted into the accommodation portion, but embodiments of the present disclosure are not limited to the above-described example.

The time at which the aerosol generating article is inserted into the accommodation portion (e.g. presently being inserted) may be shorter than the time at which user's puff has occurred, and thus, the time when a state in which the difference value is greater than the second threshold and less than or equal to the third threshold is maintained may be shorter when the aerosol generating article is inserted into the accommodation portion than when a users puff has occurred. A case where a state in which the difference value is greater than the second threshold and less than or equal to the third threshold is maintained for a preset time or more may correspond to a case where user's puff has occurred. Accordingly, it may be recognized that the aerosol generating article is not being presently inserted into the accommodation portion (e.g. previously inserted) as the determination that the aerosol generating article is inserted is withdrawn, and a case where the aerosol generating article is inserted into the accommodation portion and a case where user's puff has occurred are distinguished from each other.

FIGS. 10A-B illustrate another example of determining whether an aerosol generating article is removed from an accommodation portion of an aerosol generating apparatus.

Referring to FIGS. 10A-B, a first graph 1010 may represent a change in pressure when the aerosol generating article is removed from the accommodation portion at an average speed, and a second graph 1020 may represent a change in pressure when the aerosol generating article is slowly removed from the accommodation portion compared to the case of the first graph 1010. Horizontal axes of the first graph 1010 and the second graph 1020 illustrated in FIGS. 10A-B may indicate the time t at which the change in pressure occurs, and vertical axes may indicate the difference value P obtained by subtracting a reference value from pressure detected by a pressure sensor. FIGS. 10A-B illustrate an example to determine whether the aerosol generating article is removed from the accommodation portion, and content overlapping the content of FIG. 7 is omitted.

Users may have different speeds of insertion or removal of aerosol generating articles from each other. A space into which the aerosol generating article is inserted is limited, and thus, even though speeds at which the aerosol generating article is inserted are different from each other for each user, the amount of change in pressure due to the insertion of the aerosol generating article accumulated over time may be similar. Therefore, the aerosol generating apparatus may determine that the aerosol generating article is inserted even when the aerosol generating article is inserted into the accommodation portion at an average speed and when the aerosol generating article is inserted at a faster or slower than the average speed. In addition, this is similar to when the aerosol generating article is removed from the accommodation portion.

Even if the difference value obtained by subtracting the reference value from the pressure detected by the pressure sensor is not greater than or equal to the first threshold, when the difference value is greater than or equal to a fourth threshold less than the first threshold, the controller may be determine that the aerosol generating article is removed from the accommodation portion based on an area of a section in which the difference value is greater than or equal to the fourth threshold.

The area may indicate a value obtained by integrating the difference value in a specific section when the horizontal axis is the time t at which the change in pressure occurs and the vertical axis is the difference value P. An area of the section (for example, section a) in which the difference value is greater than or equal to the fourth threshold may indicate an area of a shaded portion in the first graph 1010, and an area of a section (for example, section b) in which the difference value is greater than or equal to the fourth threshold may indicate an area of a shaded portion in the second graph 1020.

In one embodiment, when the section in which the difference value is greater than or equal to the fourth threshold is greater than or equal to a preset time, the controller may determine that the aerosol generating article is not removed from the accommodation portion (e.g. already removed). For example, when the section in which the difference value is greater than or equal to the fourth threshold continues for 10 seconds or more, the controller may determine that the aerosol generating article is not presently being removed from the accommodation portion.

The fourth threshold may be in a range of 40 Pa to 60 Pa. For example, the fourth threshold may be 50 Pa but is not limited thereto.

A reference area by which the aerosol generating article is determined to be removed from the accommodation portion may be 3 Pa×s to 50 Pa×s. For example, when the fourth threshold is 40 Pa and the section a is 0.03 seconds in the first graph 1010 and the area of the section a is 6 Pa×s, an area of a section in which the difference value is greater than or equal to the fourth threshold is greater than or equal to 3 Pa×s and less than or equal to 50 Pa×s, and thus, the controller may determine that the aerosol generating article is removed from the accommodation portion. When it is determined that the aerosol generating article is removed from the accommodation portion, the controller may control the heater to not heat the aerosol generating article.

In another example, when the fourth threshold is 40 Pa and the section b is 0.4 seconds in the second graph 1020 and an area of the section b is 45 Pa×s, an area of a section in which the difference value is greater than or equal to the fourth threshold is greater than or equal to 3 Pa×s and less than or equal to 50 Pa×s, and thus, the controller may determine that the aerosol generating article is removed from the accommodation portion.

In one embodiment, even when the difference value obtained by subtracting the reference value from the pressure detected by the pressure sensor is not less than or equal to the second threshold, and when the difference value is less than or equal to a fifth threshold greater than the second threshold, the controller may determine whether the aerosol generating article is inserted into the accommodation portion based on an area of a section in which the difference value is less than or equal to the fifth threshold.

The fifth threshold may be in ae range of −60 Pa to −40 Pa. For example, the fifth threshold may be −50 Pa but is not limited thereto.

A reference area in which the aerosol generating article is determined to be inserted into the accommodation portion may be 3 Pa×s to 50 Pa×s. For example, when the fifth threshold is −40 Pa and a section in which the difference value is less than or equal to the fifth threshold is 0.03 seconds and an area of the section of 0.03 seconds is 6 Pa×s, an area of the section in which the difference value is less than or equal to the fifth threshold is greater than or equal to 3 pa×s and less than or equal to 50 Pa×s, and thus, the controller may determine that the aerosol generating article is inserted into the accommodation portion. When it is determined that the aerosol generating article is inserted into the accommodation portion, the controller may control the heater to heat the aerosol generating article.

In another example, when the fifth threshold is −40 Pa and a section in which the difference value is less than or equal to the fifth threshold is 0.4 seconds and an area of the section of 0.4 second is 45 Pa×s, an area of the section in which the difference value is less than or equal to the fifth threshold is greater than or equal to 3 pa×s and less than or equal to 50 Pa×s, the controller may determine that the aerosol generating article is inserted into the accommodation portion.

The aerosol generating apparatus may determine that the aerosol generating article is inserted into or removed from the accommodation portion based on an area of a section in which the difference value obtained by subtracting the reference value from the pressure detected by the pressure sensor is greater than or equal to the threshold or is less than or equal to the threshold, thereby determining whether the aerosol generating article is inserted or removed by considering a speed at which the aerosol generating article is inserted or removed. In addition, even when the threshold is set to a lower value, an area of a section greater than or equal to a threshold is considered, and thus, it is possible to distinguish between an external environmental factor such as wind and insertion or removal of an aerosol generating article.

FIG. 11 is a diagram illustrating another example of determining whether an aerosol generating article is removed from the accommodation portion of the aerosol generating apparatus.

Referring to FIG. 11, sections in which the difference value obtained by subtracting the reference value from the pressure detected by the pressure sensor within a preset time tp is greater than or equal to the fourth threshold may be a section c and a section d. FIG. 11 is continued from FIGS. 8 and 10, and thus, redundant description is omitted.

When there are a plurality of sections in which the difference value is greater than or equal to the fourth threshold within the preset time tp, it may be determined that the aerosol generating article is removed from the accommodation portion based on the sum of areas of the sections.

A reference area by which the aerosol generating article is determined to be removed from the accommodation portion may be 3 Pa×s to 50 Pa×s. For example, after a change in pressure is detected, when an area of the section c is 4 Pa×s and an area of the section d is 20 Pa×s within a preset time, the sum of the areas of the section c and section d is 24 Pa×s, and thus, the controller may determine that the aerosol generating article is removed from the accommodation portion. In another example, after the change in pressure is detected, when an area of the section c is 1 Pa×s and an area of the section d is 1.5 Pa×s, the sum of areas of the section c and the section d is 2.5 Pa×s, and thus, the controller may determine that the aerosol generating article is not removed from the accommodation portion.

In one embodiment, when there are a plurality of sections in which the pressure detected by the pressure sensor within the preset time tp is less than or equal to the fifth threshold from the reference value, it may be determined that the aerosol generating article is inserted into the accommodation portion based on the sum of areas of the sections.

FIG. 12 is a diagram illustrating another example of determining whether a user's puff has occurred.

Referring to FIG. 12, a section e may indicate a case in which an aerosol generating article is inserted in an accommodation portion, and a section f may indicate a case in which the user's puff has occurred. FIG. 12 is continued from FIG. 11, and thus, redundant description is omitted.

Speeds at which the aerosol generating article is puffed may be different from each other for each puff of a user. Even when speeds at which the user puffs the aerosol generating article are different from each other, the total amount of air that the user inhales during one-time puff may be similar, and the amount of change in pressure due to the accumulated puff over time may be similar. Therefore, the aerosol generating apparatus may determine that user's puff has occurred even when the puff has occurred at an average speed and when the puff has occurred at a speed faster or slower than the average speed.

Even when the difference value obtained by subtracting the reference value from the pressure detected by the pressure sensor is not less than or equal to the second threshold, when the difference value is less than or equal to the fifth threshold greater than the second threshold, the controller may determine that the user's puff has occurred based on an area of a section in which the difference value is less than or equal to the fifth threshold.

In one embodiment, the fifth threshold may be a value within a range of −60 Pa to −40 Pa. For example, the fifth threshold may be −50 Pa but is not limited thereto.

A reference area for determining that a user's puff has occurred may be larger than or equal to a reference area of 1000 Pa×s. For example, when an area of the section f in which the difference value is less than or equal to the fifth threshold is 2000 Pa×s and an area of the section e is 30 Pa×s, an area of the section f is larger than or equal to the reference area of 1000 Pa×s, and thus, the aerosol generating apparatus may determine that the user's puff has occurred in the section f. In addition, the area of the section e does not correspond to an area larger than or equal to the reference area of 1000 Pa×s, and thus, it may be determined that the user's puff has not occurred in the section e, but embodiments of the present disclosure are not limited thereto.

The amount of change in pressure when the aerosol generating article is inserted into the accommodation portion may be different from the amount of change in pressure when the user puffs. The amount of change in pressure when the aerosol generating article is inserted into the accommodation portion may be less than the amount of change in pressure when the user puffs. Therefore, the amount of change in pressure due to the puff accumulated over time may be distinguished from the amount of change in pressure due to insertion of the aerosol generating article accumulated over time, and the aerosol generating apparatus may determine a case in which a user's puff has occurred and a case in which the aerosol generating article is inserted into the accommodation portion.

Even when the difference value obtained by subtracting the reference value from the pressure detected by the pressure sensor is not less than or equal to the second threshold, when the difference value is less than or equal to the fifth threshold greater than the second threshold from the reference value, the controller may determine that the aerosol generating article is inserted into the accommodation portion based on an area of a section in which the difference value is less than or equal to the fifth threshold. The area of the section in which the difference value is less than or equal to the fifth threshold when it is determined that the aerosol generating article is inserted may be smaller than the area of the section in which the difference value is less than or equal to the fifth threshold when it is determined that the user's puff has occurred.

In one embodiment, a reference area for determining that the user's puff has occurred may be 1000 Pa×s or more, and the reference area for determining that the aerosol generating article is inserted into the accommodation portion may be 60 Pa×s or less. For example, when an area of the section f in which the difference value is less than or equal to the fifth threshold is 2500 Pa×s and an area of the section e is 20 Pa×s, the area of the section f is larger than or equal to the reference area of 1000 Pa for determining that the user's puff has occurred, and thus, the aerosol generating apparatus may determine that the user's puff has occurred in the section f. In addition, the area of the section e is less than or equal to the reference area of 60 Pa×s for determining that the aerosol generating article is inserted into the accommodation portion, and thus, it may be determined that the aerosol generating article is removed from the accommodation portion in the section e, but embodiments of the present disclosure are not limited thereto.

The descriptions of the above-described embodiments are merely examples, and it will be understood by one of ordinary skill in the art that various changes and equivalents thereof may be made. All differences within the scope equivalent to those described in the claims will be construed as being included in the scope of protection defined by the claims.

The invention claimed is:

1. An aerosol generating apparatus comprising:

an accommodation portion configured to accommodate an aerosol generating article;

a single pressure sensor configured to detect pressure in the accommodation portion corresponding to a change in airflow passing through an airflow passage in the accommodation portion;

a first heater and a second heater; and a controller configured to:

determine, whether the aerosol generating article is inserted into the accommodation portion or removed from the accommodation portion based on whether a value obtained by subtracting a reference value from the pressure detected by the single pressure sensor is greater than or equal to a first threshold or is less than or equal to a third threshold, determine whether a user's puff has occurred on the aerosol generating article based on whether the value is less than or equal to a second threshold; and control the first heater to heat the aerosol generating article based on determining that the aerosol generating article is inserted into the accommodation portion, and control the second heater to heat a cartridge based on determining that the user's puff has occurred.

2. The aerosol generating apparatus of claim 1, wherein the controller is configured to:

determine that the aerosol generating article is removed from the accommodation portion based on the value being greater than or equal to the first threshold, and determine that the user's puff has occurred based on the value being less than or equal to the second threshold, wherein the first threshold is a positive number, and the second threshold is a negative number.

3. The aerosol generating apparatus of claim 2, wherein the controller is configured to determine that the aerosol generating article is inserted into the accommodation portion based on the value exceeding the second threshold and being less than or equal to the third threshold, and the third threshold is a negative number and has a smaller absolute value than the second threshold.

4. The aerosol generating apparatus of claim 3, wherein the controller is configured to withdraw a determination that the aerosol generating article is inserted, based on a state in which the value exceeds the second threshold and is less than or equal to the third threshold being maintained for a preset time or longer.

5. The aerosol generating apparatus of claim 2, wherein the controller is configured to determine that the aerosol generating article is removed from the accommodation portion based on an area of a time section in which the value is greater than or equal to a fourth threshold when the value is greater than or equal to the fourth threshold, and the fourth threshold is less than the first threshold.

6. The aerosol generating apparatus of claim 2, wherein the controller is configured to determine whether the user's puff has occurred or whether the aerosol generating article is inserted into the accommodation portion based on an area of a time section in which the value is less than or equal to a fifth threshold when the value is less than or equal to the fifth threshold, and the fifth threshold is greater than the second threshold.

7. The aerosol generating apparatus of claim 6, wherein an area for determining that the user's puff has occurred is larger than an area for determining that the aerosol generating article is inserted into the accommodation portion.

8. The aerosol generating apparatus of claim 2, wherein the first threshold has a value in a range of 150 Pa to 250 Pa, and the second threshold has a value in a range of −1200 Pa to −800 Pa.

9. The aerosol generating apparatus of claim 3, wherein the third threshold has a value in a range of −250 Pa to −150 Pa.

10. The aerosol generating apparatus of claim 5, wherein the fourth threshold has a value in a range of 40 Pa to 60 Pa.

11. The aerosol generating apparatus of claim 6, wherein the fifth threshold has a value in a range of −60 Pa to −40 Pa.

* * * * *